US005750485A

United States Patent [19]

Baillely et al.

[11] Patent Number: 5,750,485

[45] Date of Patent: May 12, 1998

[54] LAUNDRY DETERGENT CONTAINING A POLYHYDROXY FATTY AMIDE AND INSOLUBLE ETHOXYLATED ALCOHOL

[75] Inventors: Gerard Marcel Baillely; Suzanne Powell, both of Newcastle upon Tyne, England

[73] Assignee: The Procter & Gamble Company, Cincinnati, Ohio

[21] Appl. No.: 468,236

[22] Filed: Jun. 6, 1995

Related U.S. Application Data

[63] Continuation of Ser. No. 162,162, filed as PCT/US92/04902, Jun. 11, 1992, published as WO92/22629, Dec. 23, 1992, abandoned.

[30] Foreign Application Priority Data

Jun. 18, 1991 [GB] United Kingdom ..... 9113139

[51] Int. Cl.[6] ..... C11D 7/18

[52] U.S. Cl. ..... 510/315; 510/299; 510/303; 510/317; 510/345; 510/350; 510/356; 510/360

[58] Field of Search ..... 252/174.21, 174.22, 252/529, 548, 550, 551, DIG. 1; 510/276, 299, 302, 303, 309, 315, 317, 345, 350, 356, 360

[56] References Cited

U.S. PATENT DOCUMENTS

| | | | |
|---|---|---|---|
| 2,965,576 | 12/1960 | Wilson | 252/137 |
| 3,654,166 | 4/1972 | Eckert et al. | 252/117 |
| 3,868,336 | 2/1975 | Mazzola et al. | 252/527 |
| 3,925,224 | 12/1975 | Winston | 252/89 |
| 3,953,382 | 4/1976 | Nelson | 252/548 |
| 4,072,621 | 2/1978 | Rose | 252/89 R |
| 4,110,262 | 8/1978 | Arnau et al. | 252/545 |
| 5,009,814 | 4/1991 | Kelkenberg et al. | 252/548 |
| 5,332,528 | 7/1994 | Pan | 252/548 |

FOREIGN PATENT DOCUMENTS

| | | | |
|---|---|---|---|
| 860898 | 1/1971 | Canada | 134/3 |
| 0330337-A | 8/1989 | European Pat. Off. | 252/548 |

OTHER PUBLICATIONS

J. Org. Chem. 1995, 60, 7348, Oct. 1995.

Synlett, Sep. 1994, p. 689.

*Primary Examiner*—Paul Lieberman
*Assistant Examiner*—John R. Hardee
*Attorney, Agent, or Firm*—Ken K. Patel; Jacobus C. Rasser; Jerry J. Yetter

[57] ABSTRACT

Detergent compositions were prepared which contain 1–10% of a fatty acid amide, in which the carbon is attached to a $C_{15}$–$C_{17}$ hydrocarbon, and wherein one of the nitrogen substituents is a polyhydroxyhydrocarbyl having a linear hydrocarbon chain with at least three hydroxyl groups pendent therefrom. Said compositions further comprise 1–6% by weight of an insoluble ethoxylated $C_{12}$–$C_{15}$ primary alcohol containing an average of three ethoxylate groups per mole.

4 Claims, No Drawings

LAUNDRY DETERGENT CONTAINING A POLYHYDROXY FATTY AMIDE AND INSOLUBLE ETHOXYLATED ALCOHOL

CROSS REFERENCE TO RELATED APPLICATION

This is a continuation of application Ser. No. 08/162,162, filed as PCT/US92/04902 Jun. 11, 1992, published as WO92/22629 Dec. 23, 1992, now abandoned.

This application relates to fabric cleaning compositions and more particularly to fabric cleaning compositions capable of providing grease and oily stain removal.

The surfactant systems of commercially available fabric cleaning compositions are designed to remove a variety of soil types from the fabric surface. The majority of such systems are based on one ore more anionic surfactants with minor levels of other surfactant types such as nonionics, ampholytics and cationics. In particular, a combination of a major proportion of anionic and a minor proportion of nonionic surfactant is commonly used to obtain an acceptable balance of particulate soil removal and grease and oily soil removal characteristics. Detergent compositions incorporating surfactant systems in which the major component is nonionic are known in the art, e.g. EP-A-0006268 and GB 2206601 but any commercial application has tended to be of a specialist nature. This is because compositions based on anionic surfactants provide acceptable detergency over a broader spectrum of soil types, display greater compatibility with adjuncts such as optical brighteners and fabric softening additives and are also less agressive towards fabric dyestuffs and washing machine components.

Accordingly, a need still exists for detergent compositions displaying improved grease and oily soil removal without any sacrifice in the removal of other soil types and without impact on the performance of other detergent ingredients.

The present invention provides laundry detergent compositions which contain nonionic surfactant systems which comprise one or more polyhydroxy fatty acid amides and one or more additional nonionic surfactants. When included in such laundry detergent compositions, these nonionic surfactant systems unexpectedly improve the effectiveness of such compositions against greasy/oily stains across a broad range of laundry conditions.

The commonly assigned copending U.S. application Ser. No. 07/573,760 (attorney's docket No. 4265) filed 28 Sep. 1990 discloses nonionic surfactant systems comprising combinations of certain polyhydroxy fatty acid amides and one ore more additional nonionic surfactants. The polyhydroxy fatty acid amides have the formula

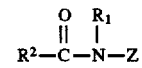

wherein $R_1$ is H, a $C_1$–$C_4$ hydrocarbyl, 2-hydroxyethyl, 2-hydroxypropyl or mixtures thereof, $R^2$ is $C_5$–$C_{31}$ hydrocarbyl and Z is a polyhydroxy hydrocarbyl having a linear hydrocarbyl chain with at least 3 hydroxyl groups directly connected to the chain, or an alkoxylated derivative thereof. The weight ratio of the polyhydroxy fatty acid amide to the additional nonionic surfactants can lie in the range from about 1:5 to about 5:1. Other surfactant types such as anionic, cationic, ampholytic, zwitterionic and semipolar can be included as optional components and detergent compositions incorporating the surfactant systems are also disclosed.

The Applicant has unexpectedly found that detergent compositions incorporating nonionic surfactant systems of this general type comprising certain combinations of polyhydroxy fatty acid amides and water insoluble ethoxylated nonionic surfactants together with other water soluble surfactants provide unexpected oil and greasy soil removal benefits with no decrease in the detergency performance on other soil types.

BACKGROUND ART

A variety of polyhydroxy fatty acid amides have been described in the art. N-acyl, N-methyl glucamides, for example, are disclosed by J. W. Goodby, M. A. Marcus, E. Chin, and P. L. Finn in "The thermotropic Liquid-Crystalline Properties of Some Straight Chain Carbohydrate Amphiphiles," Liquid Crystals, 1988. Volume 3, No. 11, pp 1569–1581, and by A. Culler-Farrow, V. Zabel, M. Steifa, and R. Wilgenfeld in "Molecular and Crystal Structure of a Nonionic Detergent: Nonanoyl-N-methylglucamide." J. Chem. Soc. Chem. Commun., 1986, pp 1573–1574. The use of N-alkyl polyhydroxyamide surfactants has been of substantial interest recently for use in biochemistry, for example in the dissociation of biological membranes. See, for example, the journal article "N-D-Gluco-N-methylalkanamide Compounds, a New Class of Non-ionic Detergents for Membrane Biochemistry," Biochem. J. (1982) Vol. 207, pp 363–366, by J. E. K. Hildreth.

The use of N-alkyl glucamides in detergent compositions has also been discussed. U.S. Pat. No. 2,965,576, issued Dec. 20, 1960 to E. R. Wilson, and G.B. Patent 809,060, published Feb. 18, 1959, assigned to Thomas Hedley & Co., Ltd. relate to detergent compositions containing anionic surfactants and certain amide surfactants, which can include N-methyl glucamide, added as a low temperature suds enhancing agent. These compounds include an N-acyl radical of a higher straight chain fatty acid having 10–14 carbon atoms. These compositions may also contain auxiliary materials such as alkali metal phosphates, alkali metal silicates, sulfates, and carbonates. It is also generally indicated that additional constituents to impart desirable properties to the compositions can also be included in the compositions, such as fluorecent dyes, bleaching agents, perfumes, etc.

U.S. Pat. No. 2,703,798, issued Mar. 8, 1955 to A. M. Schwartz, relates to aqueous detergent compositions containing the condensation reaction product of N-alkyl glucamine and an aliphatic ester of a fatty acid. The product of this reaction is said to be useable in aqueous detergent compositions without further purification. It i also known to prepare a sulfuric ester of acylated glucamine as disclosed in U.S. Pat. No. 2,717,894, issued Sep. 13, 1955, to A. M. Schwartz.

PCT International Application WO 83/04412, published Dec. 22, 1983, by J. Hildreth, relates to amphiphilic compounds containing polyhydroxyl aliphatic groups said to be useful for a variety of purposes including use as surfactants in cosmetics, drugs, shampoos, lotions, and eye ointments, as emulsifiers and dispensing agents for medicines, and in biochemistry for solubilizing membranes, whole cells, or other tissue samples, and for preparing of liposomes. Included in this disclosure are compounds of the formula $R'CON(R)CH_2R''$ and $R''CON(R))R'$ and wherein R is hydrogen or an organic grouping, R' is an aliphatic hydrocarbon group of at least three carbon atoms, and R" is the residue of an aldose.

European Patent 0 285 768, published Oct. 12, 1988, H. Kalkenberg, et al., relates to the use of N-polyhydroxy alkyl fatty acid amides as thickening agents in aqueous detergent systems. Included are amides of the formula $R_1C(O)N(X)R_2$ wherein $R_1$ is a $C_1$–$C_{17}$ (preferably $C_7$–$C_{17}$) alkyl, $R_2$ is hydrogen, a $C_1$–$C_{18}$ (preferably $C_1$–$C_6$) alkyl, or an alkylene oxide, and X is a polyhydroxy alkyl having four to seven carbon atoms, e.g., N-methyl, coconut fatty acid glucamide. The thickening properties of the amides are indicated as being of particular use in liquid surfactant systems containing paraffin sulfonate, although the aqueous surfactant systems can contain other anionic surfactants, such as alkylaryl sulfonates, olefin sulfonate, sulfosuccinic acid half ester salts, and fatty alcohol ether sulfonates, and nonionic surfactants such as fatty alcohol polyglycol ether, alkylphenol polyglycol ether, fatty acid polyglycol ester, polypropylene oxide-polyethylene oxide mixed polymers, etc. Paraffin sulfonate/N-methyl coconut fatty acid glucamide/nonionic surfactant shampoo formulations are exemplified. In addition to thickening attributes, the N-polyhydroxy alkyl fatty acid amides are said to have superior skin tolerance attributes.

U.S. Pat. No. 2,982,737, issued May 2, 1961, to Boettner, et al., relates to detergent bars containing urea, sodium lauryl sulfate anionic surfactant, and an N-alkylglucamide nonionic surfactant which is selected from N-methyl, N-sorbityl lauramide and N-methyl, N-sorbityl myristamide.

Other glucamide surfactants are disclosed, for example, in DT 2,226,872, published Dec. 20, 11973, M. W. Eckert, et al., which relates to washing compositions comprising one or more surfactants and builder salts selected from polymeric phosphates, sequestering agents, and washing alkalis, improved by the addition of an N-acylpolyhydroxyalkylamine of the formula $R_1C(O)N(R_2)CH_2(CHOH)_nCH_2OH$, wherein $R_1$ is a $C_1$–$C_3$ alkyl, $R_2$ is a $C_{10}$–$C_{22}$ alkyl, and n is 3 or 4. The N-acylpolyhydroxyalkyl-amine is added as a soil suspending agent.

U.S. Pat. No. 3,654,166, issued Apr. 4, 1982, to H. W. Eckert, et al., relates to detergent compositions comprising at least one surfactant selected from the group of anionic, zwitterionic, and nonionic surfactants and, as a textile softener, an N-acyl, N-alkyl polyhydroxylalkyl compound of the formula $R_1N(Z)C(O)R_2$ wherein $R_1$ is a $C_{10}$–$C_{22}$ alkyl, $R_2$ is a $C_7$–$C_{21}$ alkyl. $R_1$ and $R_2$ total from 23 to 39 carbon atoms, and Z is a polyhydroxyalkyl which can be $—CH_2(CHOH)_mCH_2OH$ where m is 3 or 4.

U.S. Pat. No. 4,021,539, issued May 3, 1977, to H. Müller, et al., relates to skin treating cosmetic compositions containing N-polyhydroxylalkyl-amines which include compounds of the formula $R_1N(R)CH(CHOH)_mR_2$ wherein $R_1$ is H, lower alkyl, hydroxy-lower alkyl, or aminoalkyl, as well as heterocyclic aminoalkyl, R is the same as $R_1$ but both cannot be H, and $R_2$ is $CH_2OH$ or COOH.

French Patent 1,360,018, Apr. 26, 1963, assigned to Commercial Solvents Corporation, relates to solutions of formaldehyde stabilized against polymerization with the addition of amides of the formula $RC(O)N(R_1)G$ wherein R is a carboxylic acid functionality having at least seven carbon atoms. $R_1$ is hydrogen or a lower alkyl group, and G is a glycitol radical with at least 5 carbon atoms.

German Patent 1,261,861, Feb. 29, 1968, A. Heins, relates to glucamine derivatives useful as wetting and dispersing agents of the formula $N(R)(R_1)(R_2)$ wherein R is a sugar residue of glucamine, $R_1$ is a $C_{10}$–$C_{20}$ alkyl radical, and $R_2$ is a $C_1$–$C_5$ acyl radical.

G.B. Patent 745,036, published Feb. 15, 1956, assigned to Atlas Powder Company, relates to heterocyclic amides and carboxylic esters thereof that are said to be useful as chemical intermediates, emulsifiers, wetting and dispersing agents, detergents, textile softeners, etc. The compounds are expressed by the formula $N(R)(R_1)C(O)R_2$ wherein R is the residue of an anhydrized hexane pentol or a carboxylic acid ester thereof, $R_1$ is a monovalent hydrocarbon radical, and $—C(O)R_2$ is the acyl radical of a carboxylic acid having from 2 to 25 carbon atoms.

U.S. Pat. No. 3,312,627, issued Apr. 4, 1967 to D. T. Hooker, discloses solid toilet bars that are substantially free of anionic detergents and alkaline builder materials, and which contain lithium soap of certain fatty acids, a nonionic surfactant selected from certain propylene oxide-ethylenediamine-ethylene oxide condensates, propylene oxide-propylene glycol-ethylene oxide condensates, and polymerized ethylene glycol, and also contain a nonionic lathering component which can include polyhydroxyamide of the formula $RC(O)NR^1(R^2)$ wherein RC(O) contains from about 10 to about 14 carbon atoms, and $R^1$ and $R^2$ each are H or $C_1$–$C_6$ alkyl groups, said alkyl groups containing a total number of carbon atoms of from 2 to about 7 and a total number of substituent hydroxyl groups of from 2 to about 6. A substantially similar disclosure is found in U.S. Pat. No. 3,312,626, also issued Apr. 4, 1967 to D. T. Hooker.

The use of nonionic surfactants in detergent compositions is known in the art. U.S. Pat. No. 3,654,166, issued Apr. 4, 1972 to Eckert et al., discloses detergent compositions comprising a surfactant selected from anionics, zwitterionics and nonionics and an N-alkyl-N-acyl-N-polyhydroxyalkyl compound.

Another disclosure of the use of nonionic surfactants in detergent compositions is provided by GB Patent 1231754 which teaches that ethylene oxide adducts of $C_8$–$C_{15}$ substantially unbranched monohydric alcohols having an average ethylene oxide content of from 10% to 51% by weight can serve as detergency improvers for water soluble organic anionic or nonionic surfactants. The improvers are used in a weight ratio of surfactant to improver of from 5:1 to 1:1. However, the reference does not contemplate the combinations of the present invention that employ water insoluble polyhydroxy fatty acid amide surfactants as well as defined water insoluble ethyoxylated nonionic surfactants.

According to the present invention, there is provided a laundry detergent composition useful for cleaning fabrics in automatic washing machines, said composition comprising one or more water soluble anionic, cationic, ampholytic or zwitterionic detersive surfactants or mixtures thereof, and optionally detergent builder compounds, said composition being characterised in that it comprises, in combination, (a) at least 1% by weight of the composition of a polyhydroxy fatty acid amide having the formula

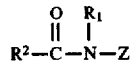

where $R_1$ is H, $C_1$–$C_4$ hydrocarbyl, 2-hydroxyethyl, 2-hydroxypropyl or a mixture thereof, $R_2$ is $C_5$–$C_{31}$ hydrocarbyl and Z is a polyhydroxyhydrocarbyl having a linear hydrocarbon chain with at least 3 hydroxy groups directly connected to said chain, or an alkyoxylated derivative thereof; and (b) at least 1% by weight of the composition of a substantially water-insoluble ethoxylated $C_{11}$–$C_{15}$ primary aliphatic alcohol containing an average of no more than five ethylene oxide groups per mole and having an ethylene oxide content of less than 50% by weight.

Preferably the composition is granular and comprises from 3% to 15% by weight of anionic surfactant, from 1% to 10% of component (a) and from 1% to 10% of component (b), the weight ratio of anionic surfactant to the combined weights of components (a) and (b) lying in the range from 1:3 to 3:1. More preferably the anionic surfactant comprises a mixture of a major proportion of a water soluble $C_{14}$–$C_{15}$ alkyl sulfate and a minor proportion of a $C_{12}$–$C_{15}$ alkyl ethoxy sulfate containing an average of three ethoxy groups per mole of alkyl ethoxy sulfate.

The detergent composition of the present invention comprise three essential components, viz. a polyhydroxy fatty acid amide, a water insoluble ethylene oxide adduct of a $C_{11}$–$C_{15}$ aliphatic alcohol and a water soluble surfactants that may be anionic, cationic, ampholytic or zwitterionic.

Polyhydroxy Fatty Acid Amide

The polyhydroxy fatty acid amide surfactant component of the present invention comprises compounds of the structural formula:

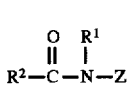

(I)

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_{11}$–$C_{19}$ alkyl or alkenyl, more preferably straight chain $C_{15}$–$C_{19}$ alkyl or alkenyl, most preferably straight chain $C_{15}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2—OH$, $—CH(CH_2OH)—(CHOH)_{n-1}—CH_2OH$, $—CH_2—(CHOR)_2(CHOR')—CH_2OH$, where n is an integer from 3 to 5, inclusive, and R' is H or a cyclic or aliphatic monosaccharide, and alkoxylated derivatives thereof. Most preferred are lycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-doexygalactityl, 1-deoxymannityl, 1-deoxymaltotriotityl, etc.

The most preferred polyhydroxy fatty acid amide has the general formula

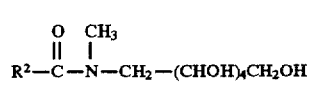

wherein $R^2$ is a $C_{11}$–$C_{19}$ straight-chain alkyl or alkenyl group.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,2965,576, issued Dec. 20, 1960 to E. R. Wilson, and U.S. Pat. No. 2,703,798, Anthony N. Schwartz, issued Mar. 8, 1955, and U.S. Pat. No. 1,985,424, issued Dec. 25, 1934 to Piggott, each of which is incorporated herein by reference.

In a preferred process for producing N-alkyl or N-hydroxyalkyl, N-deosyglycityl fatty acid amides wherein the glycityl component is derived from glucose and the N-alkyl or N-hydroxyalkyl functionality is N-methyl, N-ethyl, N-propyl, N-butyl, N-hydroxyethyl, or N-hydroxypropyl, the product is made by reacting N-alkyl:—or N-hydroxyalkyl-glucamine with a fatty ester selected from fatty methyl esters, fatty ethyl esters, and fatty triglycerides in the presence of a catalyst selected from the group consisting of trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole % to about 10 mole %, on an N-alkyl or N-hydroxyalkyl-glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglycosides, linear glycamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 25 to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate. A detailed experimental procedure is provided below in the Experimental.

The polyhydroxy "fatty acid" amide materials used herein also offer the advantages to the detergent formulator that they can be prepared wholly or primarily from natural, renewable, non-petrochemical feedstocks and are degradable. They also exhibit low toxicity to aquatic life.

In particularly preferred embodiment of the invention the polyhydroxy fatty acid amide materials are sourced from tallow fat such that $R^2$ is a $C_{15}$–$C_{17}$ straight chain alkyl group. It should be recognized that along with the polyhydroxy fatty acid amides of Formula (I), the processes used to produce them will also typically produce quantities of nonvolatile by-product such as esteramides and cyclic polyhydroxy fatty acid amide. The level of these by-products will vary depending upon the particular reactants and process conditions. Preferably, the polyhydroxy fatty acid amide incorporated into the detergent compositions hereof will be provided in a form such that the polyhydroxy fatty acid amid-containing compositions added to the detergent contains less than about 10% , preferably less than about 4%, of cyclic polyhydroxy fatty acid amide. The preferred processes described above are advantageous in that they can yield rather low levels of by-products, including such cyclic amide by-products.

The polyhydroxy fatty acid amide component is present at a level of at least 1% by weight of the composition, more preferably at a level of from 1% to 10% by weight and most preferably at a level of from 2% to 6% by weight.

Nonionic Surfactants

Laundry detergent compositions of the present invention comprise, in addition to the polyhydroxy fatty acid amide component, one or more of the nonionic surfactants described herein. The nonionic surfactants described herein will hereinafter by referred to as "additional nonionic surfactants." Nonionic compounds other than these additional nonionic surfactants may be optionally included in the nonionic surfactant system of the present invention. These other, optional nonionic compounds will hereinafter be referred to as "optional nonionics." Without intending to be limited thereby, it is believed that when such optional nonionics are included in the nonionic surfactant system of the present invention, they do not provide the unexpected stain-removal benefits already described herein.

Additional Nonionic Surfactants

Primary $C_{11}$–$C_{15}$ aliphatic condensed with an average of no more than five ethylene oxide groups per mole of alcohol comprise the additional nonionic surfactants useful in compositions of the present invention. Such alcohol ethyoxylates should have an ethylene oxide content of less than 50% by weight and should be water insoluble.

A preferred aliphatic alcohol ethoxylate is a linear or substantially linear aliphatic alcohol containing an average of 12–15 carbon atoms in the alkyl chain, ethoxylated with an average of three ethoxy groups per mole of alcohol.

The additional nonionic surfactant is present at a level of at least 1%, preferably from 1% to 10% and more preferably from 1% to 6% by weight of the composition.

The third essential component of laundry detergent compositions in accordance with the invention is one or more water soluble surfactants selected from anionic, cationic, ampholytic and zwitterionic surfactants.

Anionic Surfactants

The laundry detergent compositions of the present invention can contain, in addition to the nonionic surfactant system of the present invention, one or more anionic surfactants as described below.

Alkyl Ester Sulfonate Surfactant

Alkyl ester sulfonate surfactants hereof include linear esters of $C_8$–$C_{20}$ carboxylic acids (i.e., fatty acids) which are sulfonated with gaseous $SO_3$ according to "The Journal of the American Oil Chemists Society," 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

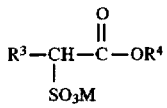

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and N is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Alkyl Sulfate Surfactant

Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like).

Alkyl chains of 12–16 carbon atoms, more preferably 14–15 carbon atoms are preferred.

Alkyl Alkoxylated Sulfate Surfactant

Alkyl alkoxylated sulfate surfactants hereof are water soluble salts or acids of the formula $RO(A)_mSO_3H$ where R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably an alkyl group having from 12 to 18 carbon atoms, especially from 12 to 15 carbon atoms.

A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium cations and quaternary ammonium cations such as tetramethyl-ammonium and dimethyl piperidinium cations and those derived from alkylamines such as ethylamine, diethylamine, triethylamine, mixtures thereof, and the like.

Preferred examples of alkyl alkoxylated sulfate surfactants are the $C_{12}$–$C_{18}$ alkyl ethoxy sulfates containing an average of up to three ethoxy groups per mole of alkyl ethoxy sulfate.

A particularly preferred surfactant is $C_{12}$–$C_{15}$ alkyl polyethoxylate (3.0) sulfate ($C_{12}$–$C_{15}$ E(3.0)M). Other exemplary surfactants include $C_{12}$–$C_{18}$ alkyl polyethoxylate (1.0) sulfate ($C_{12}$–$C_{18}$ E(1.0)M, $C_{12}$–$C_{18}$ alkyl polyethoxylate (2.25) sulfate ($C_{12}$–$C_{18}$E(2.25)M, $C_{12}$–$C_{18}$ alkyl polyethoxylate (3.0) sulfate ($C_{12}$–$C_{18}$E(3.0)M, and $C_{12}$–$C_{18}$ alkyl polyethoxylate (4.0) sulfate ($C_{12}$–$C_{18}$E(4.0)M, wherein M is conveniently selected from sodium and potassium.

Other Anionic Surfactants

Other anionic surfactants useful for detersive purposes can also be included in the laundry detergent compositions of the present invention. These can include salts (including, for example, sodium, potassium, ammonium, and substituted ammonium salts such as mono, di- and triethanolamine salts) of soap, $C_9$–$C_{20}$ linear alkylbenzenesulfonates, $C_8$l–$C_{22}$ primary or secondary alkanesulfonates, $C_8$–$C_{24}$ olefinsulfonates, sulfonated polycarboyxlic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinate, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_kCH_2COO^-N^+$ wherein R is a $C_8$–$C_{22}$ alkyl, k is an integer from 0 to 10, and N is a soluble salt-forming cation. Resin acids and hydrogenated resin acids are also suitable, such as rosin, hydrogenated rosin, and resin acids and hydrogenated resin acids present in or derived from tall oil. Further examples as described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred anionic surfactant systems employed in the laundry detergent compositions of the invention are free of alkyl benzene sulfonate salts. A highly preferred system comprises a mixture of a major proportion of a water-soluble $C_{14}$–$C_{15}$ alkyl sulfate and a minor proportion of a $C_{12}$–$C_{15}$ alkyl ethoxysulfate containing an average of three ethoxy groups per mole of alkyl ethoxy sulfate. The laundry detergent compositions of the present invention typically comprise from about 1% to about 20%, preferably from about 3% to about 15% and most preferably from 5% to 10% by weight of anionic surfactants.

Other Surfactants

The laundry detergent compositions of the present invention may also contain cationic, ampholytic, zwitterionic, and semi-polar surfactants Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of $—CH_2CH_2—$, $—CH_2CN(CH_3)—$, $—CH_2CH(CH_2OH)—$, $—CH_2CH_2CH_2—$, and mixtures thereof: each $R^4$ is selected from the group consisting of $C_1$–$C_4$ alkyl, $C_1$–$C_4$ hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0: $R^5$, is the same as $R^4$ or is an alkyl chain wherein the total number of carbon atoms of $R^2$ plus $R^5$ is not more than about 18; each y is from 0 to about 10 and the sum of the y values is from 0 to about 15: and X is any compatible anion.

Other cationic surfactants useful herein are also described in U.S. Pat. No. 4,228,044, Cambre, issued Oct. 14, 1980, incorporated herein by reference.

When included therein, the laundry detergent compositions of the present invention typically comprise from 0% to about 25%, preferably from about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 (herein incorporated by reference) for example of ampholytic surfactants.

When included therein, the laundry detergent compositions of the present invention typically comprise from 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 (herein incorporated by reference) for examples of zwitterionic surfactants.

When included therein, the laundry detergent compositions of the present invention typically comprise from 0% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

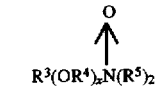

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the laundry detergent compositions of the present invention typically comprise from 0% to about 15%, preferably from about 1% to about 10% by weight of such semi-polar nonionic surfactants.

Builders

The laundry detergent compositions of the present invention can comprise inorganic or organic detergent builders to assist in mineral hardness control.

The level of builder can vary widely depending upon the end use of the composition and its desired physical form. Liquid formulations typically comprise at least about 1%, more typically from about 5% to about 50%, preferably about 5% to about 30%, by weight of detergent builder. Granular formulations typically comprise at least about 1%, more typically from about 10% to about 80%, preferably from about 15% to about 50% by weight of the detergent builder. Lower or higher levels of builder, however, are not meant to be excluded.

Inorganic detergent builders include, but are not limited to, the alkali metal, ammonium and alkanelammonium salts of polyphosphates (exemplified by the tripolyphosphates, phytic acid, silicates, carbonates (including bicarbonates and sesquicarbonates), sulfates, and aluminosilicates. Borate builders, as well as builders containing borate-forming materials that can produce borate under detergent storage or wash conditions can also be used but are not preferred at wash conditions less than about 50° C., especially less than about 40° C. Preferred builder systems are also free of phosphates.

Examples of silicate builders are the alkali metal silicates, particularly these having a $SiO_2$:$Na_2O$ ratio in the range 1.6:1 to 3.2.1, and layered silicates, such as the layered sodium silicates.

Preferred crystalline layered sodium silicates have the general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043, incorporated herein by reference. For the purposes of the present invention, x in the general formula above has a value of 2, 3 or 4 and is preferably 2. More preferably M is sodium and y is 0 and preferred examples of this formula comprise the α0, β- γ- and δ- forms of $Na_2Si_2O_5$. These materials are available from Hoechst AG FRG as respectively NaSKS-5, NaSKS-7, NaSKS-11 and NaSKS-6. The most preferred material is δ-$Na_2Si_2O_5$, NaSKS-6.

Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates, including sodium carbonate and sesquicarbonate and mixtures thereof with ultra-fine calcium carbonate as disclosed in German Patent Application No. 2,321,001 published on Nov. 15, 1973, the disclosure of which is incorporated herein by reference.

Aluminosilicate builders are especially useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2.ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCo_3$ hardness per gram of anhydrous aluminosilicate. Preferred aluminosilicates are zeolite builders which have the formula:

$$Na_z[(AlO_2)_z(SiO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Preferably, the aluminosilicate has a particle size of about 0.1–10 microns in diameter.

Specific examples of polyphosphates are the alkali metal tripolyphosphates, sodium, potassium and ammonium pyrophosphate, sodium and potassium and ammonium pyrophosphate, sodium and potassium orthophosphate, sodium polymeta phosphate in which the degree of polymerization ranges from about 6 to about 21, and salts of phytic acid.

Examples of phosphonate builder salts are the water-soluble salts of ethane 1-hydroxy-1,1-diphosphonate particularly the sodium and potassium salts, the water-soluble salts of methylene diphosphonic acid e.g. the trisodium and tripotassium salts and the water-soluble salts of substituted methylene diphosphonic acids, such as the trisodium and tripotassium ethylidene, isopyropylidene benzylmethylidene and halo methylidene phosphonates. Phosphonate builder salts of the aforementioned types are disclosed in U.S. Pat. Nos. 3,159,581 and 3,213,030 issued Dec. 1, 1964 and Oct. 19, 1965, to Diehl; U.S. Pat. No. 3,422,021 issued Jan. 14, 1969, to Roy; and U.S. Pat. Nos. 3,400,148 and 3,422,137 issued Sep. 3, 1968, and Jan. 14, 1969 to Quimby, said disclosures being incorporated herein by reference.

Polycarboxylate builder can generally be added to the composition in acid form, but can also be added in the form of a neutralized salt. When utilized in salt form, alkali metals, such as sodium, potassium, and lithium salts, especially sodium salts, or ammonium and substituted ammonium (e.g., alkanolammonium) salts are preferred.

Included among the polycarboxylate builders are a variety of categories of useful materials. One important category of polycarboxylate builders encompasses the other polycarboxylates. A number of ether polycarboxylates have been disclosed for use as detergent builders. Examples of useful ether polycarboxylates include oxydisuccinate, as disclosed in Berg, U.S. Pat. No. 3,128,267, issued Apr. 7, 1964, and Lamberti et al., U.S. Pat. No. 3,635,830, issued Jan. 18, 1972, both of which are incorporated herein by reference.

A specific type of ether polycarboxylates useful as builder in the present invention also include those having the general formula:

$$CH(A)(COOX)—CH(COOX)—O—CH(COOX)—CH(COOX)(B)$$

wherein A is H or OH; B is H or —O—CH(COOX)—$CH_2$(COOX); and X is or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80 These builders are disclosed in U.S. Pat. No. 4,663,071, issued to Bush et al., on May 5, 1987.

Suitable ether polycarboxylates also include cyclic compounds, particularly alicyclic compounds, such as these described in U.S. Pat. Nos. 3,923,679; 3,335,163; 4,158,635; 4,120,874 and 4,102,903, all of which are incorporated herein by reference.

Other useful detergency builders include the ether hydroxypolycarboxylates represented by the structure:

$$HO—[C(R)(COOM)—C(R)(COOM)—O]_nH$$

wherein M is hydrogen or a cation wherein the resultant salt is water-soluble, preferably in alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Still other ether polycarboxylates include copolymers of maleic anhydride with ethylene or vinyl methyl ether, 1, 3, 5-trihydroxy benzene-2, 4, 6-trisulfonic acid, and carboxymethyloxysuccinic acid.

Organic polycarboxylate builders also include the various alkali metal, ammonium and substituted ammonium salts of polyacetic acids. Examples of polyacetic acid builder salts are the sodium, potassium, lithium, ammonium and substituted ammonium salts of ethylenediamine tetraacetic acid and nitrilotriacetic acid.

Also included are polycarboxylates such as mellitic acid, succinic acid, polymaleic acid, benzene 1,3,5-tricarboxylic acid, benezene pentacarboxylic acid, and carboxymethyloxysuccinic acid, and soluble salts thereof.

Citric builders, e.g., citric acid and soluble salts thereof, in a polycarboxylate builder of particular importance for heavy duty liquid detergent formulations, but can also be used in granular compositions. Suitable salts include the metal salts such as sodium, lithium, and potassium salts, as well as ammonium and substituted ammonium salts.

Other carboxylate builders include the carboxylated carbohydrates disclosed in U.S. Pat. No. 3,723,322, Diehl, issued Mar. 28, 1973, incorporated herein by reference.

Also suitable in the laundry detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Useful succinic acid builders include the $C_5$–$C_{20}$ alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsuccinate, myristylsuccinate, palmitylsuccinate, 2-dodecenylsuccinate (preferred), 2-pentadecenylsuccinate, and the like. Laurysuccinates are the preferred builders of this group, and are described in European Patent Application 86200690.5/0,200,263, published Nov. 5, 1986.

Examples of useful builders also include sodium and potassium carboxymethyloxymalonate, carboxymethyloxysuccinate, cis-cyclohexanehexacarboxylate, cis-cyclopentane-tetracarboxylate, water-soluble polyacrylates (these polyacrylates having molecular weights to above about 2,000 can also be effectively utilized as dispersants), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acid such as maleic acid, itaconic acid, mesacomin acid, furmaric acid, aconitic acid, citraconic acid and methylenemalonic acid.

Other organic builders known in the art can also be used. For example, monocarboxylic acids, and soluble salts thereof, having long chain hydrocarbyls can be utilized. These would include materials generally referred to as "soaps." Chain lengths of $C_{10}$–$C_{20}$ are typically utilized. The hydrocarbyls can be saturated or unsaturated.

Enzymes

Detersive enzymes can be included in the laundry detergent compositions of the present invention for a variety of reasons including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Suitable examples of proteases are the *subtilisins* which are obtained from particular strains of *B.subtilis* and *B.licheniforms*. Another suitable protease is obtained from a strain of Bacillus, having maximum activity throughout the pH range of 8–12, developed and sold by Novo Industries A/S under the registered trade name Esperase®. The preparation of this enzyme and analogous enzymes is described in British patent specification No. 1,243,784 of Novo. Proteolytic enzymes suitable for removing protein-based stains that are commercially available include those sold under the tradenames ALCALASe™ and SAVINASE™ by Novo Industries A/S (Denmark) and MAXATASE™ by International Bio-Synthetics, Inc. (The Netherlands).

Of interest in the category of proteolytic enzymes, especially for liquid detergent compositions, are enzymes referred to herein as Protease A and Protease B. Protease A and methods for its preparation are described in European Patent Application 130,756, published Jan. 9, 1985, incorporated herein by reference. Protease B is a proteolytic enzyme which differs from Protease A in that it has a leucine substituted for tyrosine in position 217 in its amino acid sequence. Protease B is described in European Patent Application Serial No. 87303761.8*, filed Apr. 28, 1987, incorporated herein by reference. Methods for preparation of Protease B are also disclosed in European Patent Application 130,756, Bott et al., published Jan. 9, 1985, incorporated herein by reference.

Amylases include, for example, α-amylases obtained from a special strain of *B.licheniforms*, described in more detail in British patent specification No. 1,296,839 (Novo, previously incorporated herein by reference. Amylolytic proteins include, for example, RAPIDASE™, International Bio-Synthetics, Inc. and TERMAMYL™, Novo Industries.

The celluloases usable in the present invention include both bacterial or fungal cellulase. Preferably, they will have a pH optimum of between 5 and 9.5. Suitable cellulases are disclosed in U.S. Pat. No. 4,435,307, Barbesgoard et al., issued Mar. 6, 1984, incorporated herein by reference, which discloses fungal cellulase produced from *Humicola insolens*. Suitable cellulases are also disclosed in GB-A-2,075,028; GB-A-2,095,275 and DE-OS-2,247,832.

Examples of such cellulases are cellulases produced by a stain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Suitable lipase enzymes for detergent usage include those produced by microorganisms of the Pseudomonas group, such as *Pseudomonas stutzeri* ATCC 19.154, as disclosed in British Patent No. 1,372,034, incorporated herein by reference. Suitable lipases include those which show a positive immunological cross-reaction with the antibody of the lipase, produced by the microorganism *Pseudomonas fluorescens* IAM 1057. This lipase and a method for its purification have been described in Japanese Patent Application No. 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Such lipases of the present invention should show a positive immunological cross reaction with the Amano-P antibody, using the standard and well-known immunodiffusion procedure according to Ouchterlony (Acta. Med. Scan., 133, pp. 76–79 (1950)). These lipase, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Psuedomonas nitroreducens* var. *lipolyticum* FERM P 1338 (available under the trade name Amano-CES), lipases ex *Chromobacter viscosum*, e.g. *Chromobacter viscosum* var. *lipolyticum* NRRLB 3673, commercially available from Toyo Jozo Co., Tagata, Japan: and further *Chromobacter viscosum* lipases from U.S. Biochemical Corp., U.S.A. and Disoynth Co., The Netherlands, and lipases ex *Pseudomonas gladioli*. An especially preferred lipase enzyme is manufactured and sold by Novo Industri A/S, Denmark, under the trade name Lipolase (Biotechnology Newswatch, 7 Mar. 1988, p. 6) and mentioned, along with other suitable lipases, in EP O 258 068 (Novo), incorporated herein by reference.

Peroxidase enzymes are used in combination with oxygen sources, e.g., percarbonates, perborate, persulfate, hydrogen peroxide, etc. They are used for "solution bleaching," i.e. to prevent transfer of dyes or pigments removed from substrates during wash operations to ether substrates in the wash solution. Peroxidase enzymes are known in the art, and include, for example, horseradish peroxidase, ligninase, and haloperoxidase such as chloro- and brom-peroxidase. Peroxidase-containing detergent compositions are disclosed, for example, in PCT International Application WO 89/099813, published Oct. 19, 1989, by O. Kirk, assigned to Novo Industries A/S, incorporated herein by reference.

A wide range of enzyme materials and means for their incorporation into synthetic detergent granules is also disclosed in U.S. Pat. No. 3,553,139, issued Jan. 5, 1971 to McCarty et al. (incorporated herein by reference). Enzymes are further disclosed in U.S. Pat. No. 4,101,487, Place et al., issued Jul. 18, 1978, and in U.S. Pat. No. 4,507,219, Hughes, issued Mar. 26, 1985, both incorporated herein by reference. Enzyme materials useful for liquid detergent formulations, and their incorporation into such formulations, are disclosed in U.S. Pat. No. 4,261,868, Hora et al., issued Apr. 14, 1981, also incorporated herein by reference.

Enzymes are normally incorporated at levels sufficient to provide up to about 5 mg by weight, more typically about 0.5 mg to about 3 mg, of active enzyme per gram of the composition.

For granular detergents, the enzymes are preferably coated or prilled with additives inert toward the enzymes to minimize dust formation and improve storage stability. Techniques for accomplishing this are well known in the art. In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate, and calcium propionate. Calcium ions can be used in combination with short chain carboxylic acid salts, preferably formates. See, for example, U.S. Pat. No. 4,318,818, Letton, et al., issued Mar. 9, 1982, incorporated herein by reference. It has also been proposed to use polyols like glycerol and sorbitol. Alkoxy-alcohols, dialkylglycoethers, mixtures of polyvalent alcohols with polyfunctional aliphatic amines (e.g., alkanolamines such as diethanolamine, triethanoloamine, di-isopropanolamine, etc.), and boric acid or alkali metal borate. Enzyme stabilization techniques are additionally disclosed and exemplifier in U.S. Pat. No. 4,261,868, issued Apr. 14, 1981 to Horn, et al., U.S. Pat. No. 3,500,319, issued Aug. 17, 1971 to Gadge, et al., both incorporated herein by reference, and European Patent Application Publication No. 0 199 405, Application No. 86200586.5, published Oct. 29, 1986, Venegas. Non-boric acid and borate stabilizers are preferred. Enzyme stabilization systems are also described, for example, in U.S. Pat. Nos. 4,261,868, 3,600,319, and 3,519,570.

Bleaching Compounds—Bleaching Agents and Bleach Activators

The laundry detergent compositions of the present invention may contain bleaching agents or bleaching compositions containing bleaching agent and one or more bleach activators. When included, present bleaching compounds will typically comprise from about 1% to about 20%, more typically from about 1% to about 10%, of such laundry detergent composition. In general, bleaching compounds are optional components in non-liquid formulations, e.g., granular detergents. If present, the amount of bleach activators will typically be from about 0.1% to about 50%, more typically from about 0.5% to about 40% of the bleaching composition.

The bleaching agents used herein can be any of the bleaching agents useful for detergent compositions in textile cleaning, hard surface cleaning, or other cleaning purposes that are now known or become known.

One category of bleaching agent that can be used encompasses percarboxylic acid bleaching agents and salts thereof. Suitable examples of this class of agents include magnesium monoperoxyphthalate hexahydrate, the magnesium salt of meta-cloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446*, Burns et al., filed Jun. 3, 1985, European Patent Application 0,133,354, Banks et al., published Feb. 20, 1985, and U.S. Pat. No. 4,412,934, Chung et al., issued Nov. 1, 1983, all of which are incorporated by reference herein. Highly preferred bleaching agents also include 6-nonylamino-6-oxoperoxycaproic acid as described in U.S. Pat. No. 4,634,551, issued Jan. 6, 1987 to Burns, et al., incorporated herein by reference.

The laundry detergent compositions of the present invention will generally include a peroxygen bleaching agent, usually an inorganic perhydrate bleach, normally in the form of the sodium salt.

Suitable perhydrate bleaches may be any of the inorganic salts such as perborate, percarbonate, perphosphate and persilicate salts but is conventionally an alkali metal normally sodium, perborate or percarbonate. Sodium perborate can be in the form of the monohydrate of nominal formula $NaBO_2H_2O_2$ or the tetrahydrate $NaBO_2H_2O_2.3H_2O$.

Sodium percarbonate, which is the preferred perhydrate, is an addition compound having a formula corresponding to $2Na_2CO_3.3H_2O_2$, and is available commercially as a crystalline solid. Most commercially available material includes a low level of a heavy metal sequestrant such as EDTA, 1-hydroxyethylidene, 1, 1-diphosphonic acid (HEDP) or an amino-phosphonate, that is incorporated into detergent compositions during the manufacturing process. Although the percarbonate can be incorporated into detergent compositions without additional protection, preferred executions of such compositions utilise a coated form of the material. A variety of coatings can be used, but the most economical is sodium silicate of $SiO_2$:$Na_2O$ ratio from 1.6:1 to 3.4:1, preferably 2.8:1, applied as an aqueous solution to give a level of from 2% to 10%, (normally from 3% to 5%) to silicate solids by weight of the percarbonate. Magnesium silicate can also be included in the coating.

Peroxygen bleaching agents are preferably combined with bleach activators, which lead to the in situ production in aqueous solution (i.E., during the washing process) of the peroxy acid corresponding to the bleach activator.

A wide range of bleach activators can be used, examples being disclosed in Spadini et al U.S. Pat. No. 4,179,390. Preferred bleach activators include the tetraacetyl alkylene diamines, particularly tetraacetyl ethylene diamine (TAED) and tetraacetyl glycouril (TAGU).

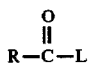

wherein R is an alkyl group containing from about 1 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 4 to about 13. These bleach activators are described in U.S. Pat. No. 4,915,854, issued Apr. 10, 1990 to Mao, et al., incorporated herein by reference, and U.S. Pat. No. 4,412,934, which was previously incorporated herein by reference.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718, issued Jul. 5, 1977 to Holcombe et al., incorporated herein by reference. Typically, detergent compositions will contain about 0.025% to about 1.25%, by weight, of sulfonated zinc phthalocyanine.

Polymeric Soil Release Agent

Any polymeric soil release agents known to those skilled in the art can be employed in the laundry detergent compositions of the present invention. Polymeric soil release agents are characterized by having both hydrophilic segments, to hydrophilize the surface of hydrophobic fibers, such as polyester and nylon, and hydrophobic segments, to deposit upon hydrophobia fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Polymeric soil release agents include cellulosic derivatives such as hydroxyether cellulosic polymers, copolymeric blocks of ethylene terephthalate or propylene terephthalate with polyethylene oxide or polypropylene oxide terephthalate, and the like.

Cellulosic derivatives that are functional as soil release agents are commercially available and include hydroxyethers of cellulose such as Methocel$^R$ (Dow).

Cellulosic soil release agents also include those selected from the group consisting of $C_1$–$C_4$ alkyl and $C_4$ hydroxyalkyl cellulose such as methylcellulose, ethylcellulose, hydroxypropyl methylcellulose, and hydroxybutyl and methylcellulose. A variety of cellulose derivatives useful as soil release polymers are disclosed in U.S. Pat. No. 4,000,093, issued Dec. 28, 1976 to Nicol, et al., incorporated herein by reference.

Soil release agents characterized by poly(vinyl) ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. Such materials are known in the art and are described in European Patent Application 0 219 048, published Apr. 22, 1987 by Kud, et al. Suitable commercially available soil release agents of this kind include the Sokalan™ type of material, e.g., Sokalan™ HP-22, available from BASF (West Germany).

One type of preferred soil release agent is a copolymer having random blocks of ethylene terephthalate and polyethylene oxide (PEO) terephthalate. More specifically, these polymers are comprised of repeating units of ethylene terephthalate and PEO terephthalate in a mole ratio of ethylene terephthalate units to PEO terephthalate units of from about 25:75 to about 35:65, said PEO terephthalate units containing polyethylene oxide having molecular weights of from about 300 to about 2000. The molecular weight of this polymeric soil release agent is in the range of from about 25,000 to about 55,000. See U.S. Pat. No. 3,959,230 to Hays, issued May 25, 1976, which is incorporated by reference. See also U.S. Pat. No. 3,893,929 to Basadur issued Jul. 8, 1975 (incorporated by reference) which discloses similar copolymers.

Another preferred polymeric soil release agent is a polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000, and the mole ratio of ethylene terephthalate units to polyoxyethylene terephthalate units in the polymeric compound is between 2:1 and 6:1. Examples of this polymer include the commercially available material Zelcon® 5126 (from Dupont) and Milease® T (from ICI). These polymers and methods of their preparation are more fully described in U.S. Pat. No. 4,702,857, issued Oct. 27, 1987 to Gosselink, which is incorporated herein by reference.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone, said soil release agent being derived from allyl alcohol ethoxylate, dimethylterephthalate, and 1,2 propylene diol, wherein the terminal moieties of each oligomer have, on average, a total of from about 1 to about 4 sulfonate groups. These soil release agents are described fully in U.S. Pat. No. 4,968,451, issued 6 Nov. 1990 to J. J. Scheibel and E. P. Gosselink, U.S. Ser. No. 07/474,709, filed Jan. 29, 1990, incorporated herein by reference.

Other suitable polymeric soil release agents include the ethyl- or methyl-capped 1,2-propylene terephthalate-polyoxyethylene terephthalate polyesters of U.S. Pat. No. 4,711,730, issued Dec. 8, 1987 to Gosselink et al., the anionic end-capped oligomeric esters of U.S. Pat. No. 4,721,580, issued Jan. 26, 1988 to Gosselink, wherein the anionic end-caps comprise sulfo-polyethoxy groups derived from polyethylene glycol (PEG), the block polyester oligomeric compounds of U.S. Pat. No. 4,702,857, issued Oct. 27, 1987 to Gosselink, having a polyethoxy end-caps of the formula $X—(OCH_2CH_2)_n—$wherein n is from 12 to about 43 and X is a $C_1$–$C_4$ alkyl, or preferably methyl, all of these patents being incorporated herein by reference.

Additional soil release polymers include the soil release polymers of U.S. Pat. No. 4,877,896, issued Oct. 31, 1989 to Maldonado et al., which discloses anionic, especially sulfoaroyl, end-capped terephthalate esters, said patent being incorporated herein by reference. The terephthalate esters contain unsymmetrically substituted oxy-1,2-alkyleneoxy units.

If utilized, soil release agents will generally comprise from about 0.01% to about 10%, preferably from about 0.1% to about 5.0%, more preferably from about 1.2% to about 3.0% by weight of the laundry detergent compositions of the present invention.

Chelating Agents

The laundry detergent compositions of the present invention may also optionally contain one or more iron and manganese chelating agents as a builder adjunct material. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents in compositions of the invention can have one or more, preferably at least two, units of the substructure

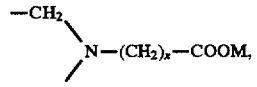

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Operable amine carboxylates include ethylenediaminetetraacetates, N-hydroxyethylathylenediaminetriacetates, nitrilotriacetates, ethylenediamine tetraproprionates, triethlenetetraaminehexaacetates, diethylenetriaminopentaacetates, and ethanoldiglycines, alkali metal, ammonium, and substituted ammoninum salts thereof and mixtures thereof.

Amino phosphonates are also suitable for use as chelating agents in the laundry detergent compositions of the present invention when at least low levels of total phosphorus are permitted in detergent compositions. Compounds with one or more, preferably at least two, units of the substructure

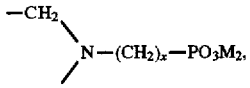

wherein M is hydrogen, alkali metal, ammonium or substituted ammonium and x is from 1 to about 3, are useful and include ethylenediaminetetrakis (methylenephosphonates), nitrilotris (methylenephosphonates) and diethylenetriaminepentakis (methylenephosphates). Preferably, these amino phosphonates do not contain alkyl or alkeny groups with more than about 6 carbon atoms. Alkylene groups can be shared by substructures.

Polyfunctionally-substituted aromatic chelating agents are also useful in the compositions herein. These materials can comprise compounds having the general formula

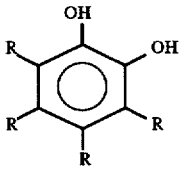

wherein at least one R is —$SO_3H$ or —COOH or soluble salts thereof and mixtures thereof. U.S. Pat. No. 3,812,044, issued May 21, 1974, to Connor et al., incorporated herein by reference, discloses polyfunctionally—substituted aromatic chelating and sequestering agents. Preferred compounds of this type in acid form are dihydroxydisulfobenzenes such as 1,2-dihydroxy-3,5-disulfobenzene. Alkaline detergent compositions can contain these materials in the form of alkali metal, ammonium or substituted ammonium (e.g. mono-or triethanol-amine) salts.

If utilized, these chelating agents will generally comprise from about 0.1% to about 10% by weight of the laundry detergent compositions of the present invention. More preferably chelating agents will comprise from about 0.1% to about 3.0% by weight of such compositions.

Clay Soil Removal/Anti-redeposition Agents

Clay soil removal/anti-redeposition agents useful in the laundry detergent compositions of the present invention include polyethylene glycols and water-soluble ethoxylated amines having clay soil removal and anti-redeposition properties.

Polyethylene glycol compounds useful in the laundry detergent compositions of the present invention typically have a molecular weight in the range of from about 400 to about 100,000, preferably from about 1,000 to about 20,000, more preferably from about 2,000 to about 12,000, most preferably from about 4,000 to about 8,000. Such compounds are commercially available and are sold as Carbowax®, which is available from Union Carbide, located in Danbury, Conn.

The water-soluble ethoxylated amines are preferably selected from the group-consisting of:

(1) ethoxylated monoamines having the formula:

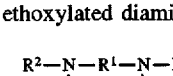

(2) ethoxylated diamines having the formula:

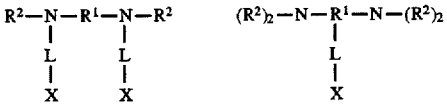

or

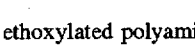

(3) ethoxylated polyamines having the formula:

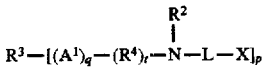

(4) ethoxylated amine polyers having the general formula:

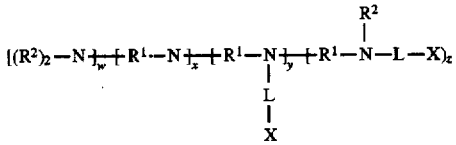

and (5) mixtures thereof; wherein $A^1$ is

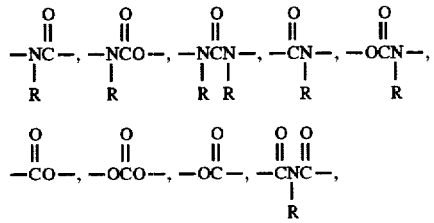

or —O—; R is H or $C_1$–$C_4$ alkyl or hydroxyalkyl; $R^1$ is $C_2$–$C_{12}$ alkylene, hydroxyalkylene, alkenylene, arylene or alkarylene, or a $C_2$–$C_3$ oxyalkylene moiety having from 2 to about 20 oxyalkylene units provided that no O—M bonds are formed; each $R^2$ is $C_1$–$C_4$ or hydroxyalkyl, the moiety —L—X, or two $R^2$ together form the moiety —$(CH_2)_r$—$A^2$—$(CH_2)_s$—, wherein $A^2$ is —O— or —$CH_2)_s$—, wherein $A^2$ is —O— or —$CH_2$—, r is 1 or 2, s is 1 and 2, and r+s is 3 or 4; X is a nonionic group, an anionic group or mixture thereof; $R^3$ is a substituted $C_1$–$C_{12}$ alkyl, hydroxyalkyl, alkenyl, aryl, or alkaryl group having substitution sites; $R^4$ is $C_1$–$C_3$ oxyalkylene moiety having from 2 to about 20 oxyalkylene units provided that no —O—O or O—N bonds are formed; L is a hydrophilic chain which contains the polyoxyalkylene moiety —$[(R^5O)_m(CH_2CH_2O_n]$—, wherein $R^5$ is $C_3$–$C_4$ alkylene or hydroxyalkylene and m and n are numbers such that the moiety —$(CH_2CH_2)_n$— comprises at least about 50% by weight of said polyoxyalkylene moiety; for said monoamines, m is from 0 to about 4, and n is at least about 12; for said diamines, m is from 0 to about 3, and n is at least about 6 when $R^1$ is $C_2$–$C_3$ alkylene, hydroxyalkylene, or alkenylene, and at least about 3 when $R^1$ is other than $C_2$–$C_3$ alkylene, hydroxyalkylene or alkenylene; for said polyamines and amine polymers, m is from 0 to about 10 and n is at least about 3; p is from 3 to 8; q is 1 or 0; t is 1 or 0, provided that t is 1 when q is 1; w is 1 or 0; x+y+z is at least 2; and y+z is at least 2. The most preferred soil release and anti-redeposition agent is ethoxylated tetraethylenepentamine. Exemplary ethoxylated amines are further described in U.S. Pat. No. 4,597,898, VanderMeer, issued Jul. 1, 1986, incorporated herein by reference. Another group of preferred clay soil removal/anti-redeposition agents are the cationic compounds disclosed in European Patent Application 11,965, Oh and Gosselink, published Jun. 27, 1984, incorporataed herein by reference. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985, all of which are incorporated herein by reference.

The most preferred soil release and anti-redeposition agents are ethoxylated tetraethylenepentamine and the polyethylene glycols having a molecular weight in the range of from about 4,000 to about 8,000.

Granular detergent compositions which contain such compounds typically contain from about 0.01% to about 10.0% by weight of the clay removal agent; liquid detergent compositions typically contain from about 0.01% to about 5.0% by weight.

Polymeric Dispersing Agents

Polymeric polycarboxylate dispersing agents can advantageously be utilized in the laundry detergent compositions of the present invention. These materials can aid in calcium and magnesium hardness control. In addition to acting as a builder adjunct analogously to the polycarboxylate described above in the Builder description, it is believe, though it is not intended to be limited by theory, that these higher molecular weight dispersing agents can further enhance overall detergent builder performance by inhibiting crystal growth of inorganics, by particulate soil peptization, and by antiredepositions, when used in combination with other builders including lower molecular weight polycarboxylates.

The polycarboxylate materials which can be employed as the polymeric polycarboxylate dispersing agent are these polymers or copolymers which contain at least about 60% by weight of segments with the general formula

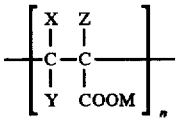

wherein X, Y, and Z are each selected from the group consisting of hydrogen, methyl, carboxy, carboxymethyl, hydroxy and hydroxymethyl; a salt-forming cation and n is from about 30 to about 400. Preferably, X is hydrogen or hydroxy, Y is hydrogen or carboxy, Z is hydrogen and M is hydrogen, alkali metal, ammonia or substituted ammonium.

Polymeric polycarboxylate materials of this type can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form ranges from about 2,000 to 10,000, more preferably from about 4,000 to 7,000 and most preferably from about 4,000 to 5,000. Water-soluble salts of such acrylic acid homopolymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. This patent is incorporated herein by reference.

Acrylic/maleic-based copolymers may also be used as a preferred component of the dispersing agent. Such materials include the water-soluble salts of copolymers of acrylic acid and maleic acid. The average molecular weight of such copolymers in the acid form ranges from about 5,000 to 100,000, preferably from about 6,000 to 60,000, more preferably from about 7,000 to 60,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, which publication is incorporated herein by reference.

If utilized, the polymeric dispersing agents will generally comprise from about 0.2% to about 10%, preferably from about 1% to about 5% by weight of the laundry detergent compositions.

Brightener

Optical brighteners or other brightening or whitening agents known to those skilled in the art can be incorporated into the laundry detergent compositions of the present invention. However, the choice of brightener will depend upon a number of factors, such as the type of detergent, the nature of other components present in the detergent composition, the temperatures of wash water, the degree of agitation, and the ratio of the material washed to tube size.

The brightener selection is also dependent upon the type of material to be cleaned, e.g., cottons, synthetics, etc. Since most laundry detergent products are used to clean a variety of fabrics, the detergent compositions should contain a mixture of brighteners which will be effective for a variety of fabrics. It is of course necessary that the individual components of such a brightener mixture be compatible.

Commercial optical brighteners can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982), the disclosure of which is incorporated herein by reference.

Stilbene derivatives include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

Certain derivatives of bis(triazinyl)aminostilbene may be prepared from 4,4'-diamine-stilbene-2,2'-disulfonic acid.

Coumarin derivatives include, but are not necessarily limited to, derivatives substituted in the 3-position, in the 7-position, and in the 3- and 7-positions.

Carboxylic acid derivatives include, but are not necessarily limited to, fumaric acid derivatives; benzoic acid derivatives; ρ-phenylene-bis-acrylic acid derivatives; naphthalene-dicarboxlic acid derivatives;; heterocyclic acid derivatives; and cinnamic acid derivatives.

Cinnamic acid derivatives can be further subclassified into groups which include, but are not necessarily limited to, cinnamic acid derivatives, styrylazoles, styrylbenzofurans, styryloxadiazoles, styryltriazoles, and styrylpolyphenyls, as disclosed on page 77 of the Zahradnik reference.

The styrylazoles can be further subclassified into styrylbenzoxazoles, styrylimidazoles and styrylthiazoles, as disclosed on page 78 of the Zahradnik reference. It will be understood that these three identified subclasses may not necessarily reflect an exhaustive list of subgroups into which styrylazoles may be subclassified.

Other optical brighteners are the derivatives of dibenzothiophene-5,5-dioxide disclosed at page 741-14 749 of *The Kirk-Othmer Encyclopedia of Chemical Technology*, Volume 3, pages 737–750 (John Wiley & Son, Inc., 1962), the disclosure of which is incorporated herein by reference, and include 3,7-diaminodibenzothiophene-2,8-disulfonic acid 5,5 dioxide.

Other optical brighteners are azoles, which are derivatives of 5-membered ring heterocycles. These can be further subcategorized into monoazoles and bisazoles. Examples of monoazoles and bisazoles are disclosed in the *Kirk-Othmer* reference.

Still other optical brighteners are the derivatives of 6-membered-ring heterocycles disclosed in the *Kirk-Othmer* reference. Example of such compounds include brighteners derived from-pyrazine and brighteners derived from 4-aminonaphthalamide.

In addition to the brighteners already described, miscellaneous agents may also be useful as brighteners. Examples of such miscellaneous agents are disclosed at pages 93-14 95 of the Zahradnik reference, and include 1-hydroxy-3,6,8-pyrenetrisulfonic acid; 2,4-dimethoxy-1,3,5-triazin-6-yl-pyrene; 4,5-diphenylimidazolonedisulfonic acid; and derivatives of pyrazolinequinoline.

Other specific examples of optical brighteners are those identified in U.S. Pat. No. 4,790,856, issued to Wixon on Dec. 13, 1988, the disclosure of which is incorporated herein by reference. These brighteners include the Phorwhite™ series of brighteners from Verona. Other brighteners disclosed in this reference include: Tinopal UNPA, Tinopal CBS and Tinopal SMB; available from Ciba-Geigy; Arctic White CC and Artic White CWD, available from Hilton-Davis, located in Italy; the 2-(4-styrylphenyl)-2H-naphthol [1,2-d]triazoles; 4,4'-bis-(1,2,3-triazol-2-yl)-stilbenes; 4,4'-bis(styryl)bisphenyls; and the y-amino-coumarins. Specific examples of these brighteners include 4-methyl-7-diethylamino coumarin; 1,2-bis(-benzimidazol-2-yl)-ethylene; 1,3-diphenylphrazolines; 2,5-bis(benzoxazol-2-yl)-thiophene; 2-styryl-naphth-[1,2-d]-oxazole; and 2-(stilbene-4-yl)-2H-naphtho[1,2-d]triazole.

Still other optical brighteners include those disclosed in U.S. Pat. No. 3,646,013, issued Feb. 29, 1972 to Hamilton, the disclosure of which is incorporated herein by reference.

If utilized, the optical brighteners will generally comprise from about 0.05% to about 2.0%, preferably from about 0.1% to about 1.0% by weight of the laundry detergent compositions.

Suds Suppressors

Compounds known, or which become known, for reducing or suppressing the formation of suds can be incorporated into the laundry detergent compositions of the present invention. The incorporation of such materials, hereinafter "suds suppressors," can be desirable because the polyhydroxy fatty acid amide surfactants hereof can increase suds stability of the detergent compositions. Suds suppression can be of particular importance when the detergent compositions include a relatively high sudsing surfactant in combination with the polyhydroxy fatty acid amide surfactant. Suds suppression is particularly desirable for compositions intended for use in front loading automatic washing machines. These machines are typically characterized by having drums, for containing the laundry and wash water, which have a horizontal axis and rotary action about the axis. This type of agitation can result in high suds formation and, consequently, in reduced cleaning performance. The use of suds suppressors can also be of particular importance under hot water washing conditions and under high surfactant concentration conditions.

A wide variety of materials may be used as suds suppressors. Suds suppressors are well known to those skilled in the art. They are generally described, for example, in Kirk Othmer Encyclopedia of Chemical Technology, Third Edition, Volume 7, pages 430-447 (John Wiley & Sons, Inc., 1979). One category of suds suppressor of particular interest encompasses monocarboxylic fatty acids and soluble salts thereof. These materials are discussed in U.S. Pat. No. 2,954,347, issued Sep. 27, 1960 to Wayne St. John, said patent being incorporated herein by reference. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium potassium, and lithium salts, and ammonium and alkanolammonium salts. These materials are a preferred category of suds suppressor for detergent compositions.

The laundry detergent compositions of the present invention may also contain non-surfactant suds suppressor. These include, for example, high molecular weight hydrocarbons such as paraffin, fatty acid esters (e.g., fatty acid triglycerides), fatty acid esters of monovalent alcohols, aliphatic $C_{18}$–$C_{40}$ ketones (e.g. stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about –40° C. and about 5° C., and a minimum boiling point not less that about 110° C. (atmospheric pressure). It is also known to utilized waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo, et al., incorporated herein by reference. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds comprises silicon suds suppressors. This category includes the use of polyorganosiloxan oils, such as polydimethylsiloxane, dispersions or emulsions of polyorganosiloxane oils or resins, and combinations of polyorganosiloxane with silica particles wherein the polyorganosiloxane is chemisorbed of fused onto the silica. Silicone suds suppressors are well known in the art and are, for example, disclosed in U.S. Pat. No. 4,265,779, issued May 5, 1981 to Gandolfo et al. and European Patent Application No. 89307851.9, published Feb. 7, 1990, by Starch, M. S., both incorporated herein by reference.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al., and in U.S. Pat. No. 4,652,392, Baginski et al., issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1500 cs. at 25° C.;

(ii) from about 5 to about 50 parts per 100 parts by weight of (i) of siloxane resin composed of $(CH_3)_3\ SiO_{1/2}$ units of $SiO_2$ units in a ratio of from $(CH_3)_3\ SiO_{1/2}$ units and to $SiO_2$ units of from about 0.6:1 to about 1.2:1; and (iii) from about 1 to about 20 parts per 100 parts by weight of (i) of a solid silica gel;

Suds suppressors when utilized, are present in a "suds suppressing amount." By "suds suppressing amount" is meant that the formulator of the composition can select an amount of this suds controlling agent that will control the suds to the extent desired. The amount of suds control will vary with the detergent surfactant selected. For example, with high sudsing surfactants, relatively more of the suds controlling agent is used to achieve the desired suds control than with low foaming surfactants.

The laundry detergent compositions of the present invention will generally comprise from 0% to about 51% of suds suppressor. When utilized as suds suppressors, monocarboxylic fatty acids, and salts thereof, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphates are generally utilized in amounts ranging from about 0.11% to about 2% by weight of the compositions.

Hydrocarbon suds suppressors are typically utilized in amounts ranging from about 0.01% to about 5.0%, although higher levels can be used.

Other Ingredients

A wide variety of other ingredients which can be included in the laundry detergent compositions of the present invention include other active ingredients, carriers, hydrotropes, processing aids, dyes or pigments, solvents for liquid formulations, etc.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g., propylene glycol, ethylene glycol, glycerine, and 1,3-propanediol) can also be used.

The laundry detergent compositions of the present invention will preferably be formulated such that during use in aqueous cleaning operations, the wash water will have a pH of between about 6.5 and about 11, preferably between about 7.5 and about 10.5. Liquid product formulations preferably have a pH between about 7.5 and about 9.5, more preferably between about 7.5 and about 9.0. Techniques for controlling pH at recommended usage levels include the use of buffers, alkali, acids, etc., and are well known to those skilled in the art.

This invention further provides a method for cleaning substrates, such as fibers, fabrics, hard surfaces, skin, etc., by contacting said substrate with a detergent composition containing the nonionic surfactant system of the present invention, wherein the weight ratio of polyhydroxy fatty acid amide to additional surfactant in the nonionic surfactant system is in the range of from about 1:5 to about 5:1, in the presence of a solvent such as water or a water-miscible solvent (e.g., primary and secondary alcohols). Agitation is preferably provided for enhancing cleaning. Suitable means for providing agitation include rubbing by hand preferably with the aid of a brush, or other cleaning device, automatic laundry washing machines, automatic dishwashers, etc.

EXPERIMENTAL

This exemplifies a process for asking a N-metyl, 1-deoxyglucityl lauramide surfactant for use herein. Although a skilled chemist can vary apparatus configuration, one suitable apparatus for use herein comprises a three-necked flask fitted with a motor-driven paddle stirrer and a thermometer of length sufficient to contact the reaction medium. The other two necks of the flask are fitted with a nitrogen sweep and a wide-bore side-arm caution: a wide-bore side -arm is important in case of very rapid methanol evolution) to which is connected an efficient collecting condenser and vacuum outlet. The latter is connected to a nitrogen bleed and vacuum gauge, then to an aspirator and a trap, A 500 watt heating mantle with a variable transformer temperature controller ("Variac") used to heat the reaction is so placed on a lab-jack that it may be readily raised or lowered to further control temperature of the reaction.

N-methylglucanine (195 g., 1.0 mole, Aldrich, M4700-0 and methyl laurate (Procter & Gamble CE 1270, 220.9 g., 1.0 mole) are placed in a flask. The solid/liquid mixture is heated with stirring under a nitrogen sweep to form a melt (approximately 25 minutes). When the melt temperature reaches 145° C. catalyst (anhydrous powdered sodium carbonate, 10.5 g., 0.01 mole, J. T. Baker) is added. The nitrogen sweep is shut off and the aspirator and nitrogen bleed are adjusted to give 5 inches (5/31 atm.) Hg. vacuum. From this point on, the reaction temperature is held at 150° C. by adjusting the Variac and/or by raising or lowering the mantle.

Within 7 minutes, first methanol bubbles are sighted at the meniscus of the reaction mixture. A vigorous reaction soon follows. Methanol is distilled over until its rate subsides. The vacuum is adjusted to give about 10 inches Hg. (10/13 atm.) vacuum. The vacuum is increased approximately as follows (in inches H. at minutes): 10 at 3, 20 at 7, 25at 10. 11 minutes from he onset of methanol evolution, heating and stirring are discontinue co-incident with some foaming. The product is cooled and solidifies.

The following examples are meant to exemplify compositions of the present invention, but are not necessarily meant to limit or otherwise define the scope of the invention, said scope being determined according to claims which follow.

The invention is illustrated in the following examples in which all amounts are by weight unless otherwise specified.

In the Examples, the abbreviated component identifications have the following meanings:

| | |
|---|---|
| $C_{12}$LAS | Sodium linear $C_{12}$ alkyl benzene sulfonate |
| TGA | Glucityl tallow fatty acid amide |
| TAS | Sodium tallow alcohol sulfate |
| $C_{14/15}$AS | Sodium $C_{14}$-C15 alkyl sulfate |
| $C_{12/15}AE_3S$ | Sodium $C_{12}$-$C_{15}$ alkyl ether sulfate containing an average of three moles of ethylene oxide per mole of alkyl sulfate |
| $TAE_n$ | Tallow alcohol ethoxylated with n moles of ethylene oxide per mole of alcohol. |
| 45E7 | A $C_{14-15}$ predominantly linear primary alcohol condensed with an average of 7 moles of ethylene oxide. |
| 25E3 | A $C_{12}$-$C_{15}$ primary alcohol condensed with an average of 3 moles of ethylene oxide. |
| TAED | Tetraacetyl ethylene diamine |
| Silicate | Amorphous Sodium Silicate ($SiO_2$:$Na_2O$ ratio normally follows). |
| Carbonate | Anhydrous sodium carbonate |
| CMC | Sodium carboxymethyl cellulose |
| Zeolite A | Hydrated Sodium Aluminosilicate of formula $Na_{12}(AlO_2SiO_2)_{12}.27H_2O$ having a primary particle size in the range from 1 to 10 micrometers |
| Citrate | Tri-sodium citrate dihydrate |
| MA/AA | Copolymer of 1:4 maleic anhydride/acrylic acid, average molecular weight about 80,000. |
| Perborate Monohydrate | Anhydrous sodium perborate bleach empirical formula $NaBO_2.H_2O_2$ |
| Enzyme | Mixed proteolytic and amyloytic enzyme sold by Novo Industries AS. |
| Brightener: | Disodium 4,4'-bis(2-morpholino-4-anilino-s-triazin-6-ylamino)stilbene-2:2'-disulphonate. |

-continued

| | |
|---|---|
| DETPMP | Diethylene triamine penta (Methylene phosphonic acid), marketed by Monsanto under the Trade name Dequest 2060 |
| SUDS Suppressor | 25% paraffin wax Mpt 50° C., 17% hydrophobic silica, 58% paraffin oil. |

EXAMPLE I

The following particulate detergent compositions were prepared:

| | A | B | C |
|---|---|---|---|
| TAS | 2.43 | | |
| $C_{14/15}$AS | 5.4 | | |
| $C_{12/15}AE_3S$ | 1.5 | | |
| TGA | 3.5 | 6.5 | — |
| 25E3 | 3.0 | — | 6.5 |
| Zeolite A | 15.0 | | |
| Citrate | 6.5 | | |
| Silicate (2.0 ratio) | 3.5 | | |
| Carbonate | 13.6 | | |
| MA/AA | 4.25 | | |
| DETPMP | 0.38 | | |
| CMC | 0.48 | | |
| TAED | 5.0 | | |
| Perborate | 16.0 | | |
| Enzyme | 1.4 | | |
| Brightener | 0.19 | | |
| Suds Suppressor | 3.0 | | |

The Performance of the three compositions was compared in both Tergotometer Tests and in full scale washing machine tests.

Tergotomeier Tests

6×2 liter metal pots were filled with water of 12° Clark Hardness (Ca:Mg=4:1) and heated to 60° C. 14g of product was added to each pot and dissolved/dispersed to give a product weight concentration of 0.7%. Stained 7.5 cm×7.5 cm cotton and polycotton fabric swatches were made by applying separate stripes of artificial sebum, shoe polish and dirty motor oil (DMO) uniformly on to each fabric swatch. A swatch of each fabric type was then attached to the paddly of each pot and the paddles were the agitated in the pots for 45 minutes. The total number of replicates for each product was 6. The swatches were then rinsed in cold water, dried overnight and then assessed by an expert panel using a five point Scheffé scale.

Washing Machine Tests

AEG Lavamat 980 automatic washing machines were used to carry out a similar comparison of the products. A 45 minute main wash cycle at 60° C. was selected and a product concentration of 0.7% in 12° Clark Hardness water (Ca:Mg=4:1) was used. Six Replicates for each product were carried out. Each wash load comprised 3 Kg of realistically solid ballast fabrics composed of cotton sheets and towels together with polycotton items to give a cotton-polycotton weight ratio of approximately 3:1, together with sets of stained swatches.

The stain sets comprised:

2 greasy stains on cotton (lipstick, DMO).

2 greasy stains on polyester (make up, polish).

After rinsing with cold water, each swatch was dried and then assessed by an expert panel using a five point Scheffé scale.

The results of both test techniques are set out below.

The LH column shows the advantage for Composition A over Composition B while the RH column shows the advantage for Composition A over Composition C.

| Tergotometer | A/B | A/C |
|---|---|---|
| Cotton | | |
| sebum | −0.3 | −0.3 |
| polish | +0.6 | +0.2 |
| DMO | +1.1(s) | +0.8 |
| Polycotton | | |
| sebum | +0.2 | +0.4 |
| polish | +0.8 | +0.5 |
| DMO | +1.5(s) | +0.5 |
| Washing Machine | | |
| Lipstick/Cotton | +1.5(s) | +0.2 |
| DMO/cotton | +1.2 | +0.5 |
| Makeup/polyester | +1.0 | +0.3 |
| Polish/polyester | +1.4(s) | +1.1(s) |

(s) = statistically significant at 95% confidence level.

Product C represents a prior art composition and the comparison A/C shows that composition A, in accordance with the invention, provides stain removal benefits relative to Composition C over a wide spectrum of soil types and fabrics. The comparison of compositions A&B shows the surprising benefit provided by the use of a combination in accordance with the invention relative to that provided by use of a higher level of the polyhydroxy fatty acid amide alone.

EXAMPLE II

Composition A of Example I was compared to a commercially available detergent composition (D) which differed from Composition A only in that the 45AS, $25AE_3S$, TGA and 25E3 components were replaced by 7.61% $C_{12}$ LAS, 3% 45E7 and 1.1% $TAE_{11}$. The comparison was carried out in AEG Lavamat 980 washing machines using the wash conditions and procedure of Example 1 and a variety of stains on cotton, polycotton and polyester fabric swatches. Assessment of the washed fabric swatches by an expert panel using a five point Scheffé scale showed that Composition A provided a stain removal benefit over Composition D of >2 psu on polish from polyester >1 psu on DMO from polycotton >1.5 psu on make up from cotton

EXAMPLE III

The performance of Composition A of Example I was compared to that of two further detergent Compositions D and E which differed from A only in that the 25E3 component was replaced by 68E3 and 68E5 respectively, where 68E3 and 68E5 are $C_{16}$–$C_{18}$ predominantly linear primary alcohols condensed with an average of three and five moles of ethylene oxide respectively. The performance comparisons were made using the conditions and procedure of the tergotometer test of Example I.

Assessment of the washed fabric swatches by an expert panel using a five point Scheffé scale showed that Composition A, in accordance with the invention, provided significant stain removal benefits over both compositions D and E, neither of which is a composition in accord with the invention.

The results of the comparisons are set out below.

The LH column shows the advantage for Composition A over Composition D while the RH column shows the advantage for Composition A over Composition E.

| | A/D | A/E |
|---|---|---|
| Polycotton | | |
| Sebum | +0.8s | +0.3 |
| polish | −0.3 | −0.6 |
| DMO | +1.8s | +2.0s |
| Polyester | | |
| sebum | +2.6s | +2.7s |
| polish | +1.6s | +0.5 |
| DMO | +0.8s | +1.5s |

s = statistically significant at 95% confidence level

We claim:

1. A laundry detergent composition useful for cleaning fabrics in automatic washing machines, said composition comprising one or more water soluble anionic, cationic, ampholytic or zwitterionic detersive surfactants or mixtures thereof, and detergent builder compounds, said composition comprising:

(a) from 1% to 10% by weight of the composition of a polyhydroxy fatty acid amide having the formula

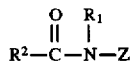

where $R_1$ is H, $C_1$–$C_4$ hydrocarbyl, 2-hydroxyethyl, 2-hydroxypropyl or a mixture thereof, $R_2$ is $C_3$–$C_{31}$ hydrocarbyl, and Z is a polyhydroxyhydrocarbyl having a linear hydrocarbon chain with at least hydroxy groups directly connected to said chain, or an alkoxylated derivative thereof;

(b) from 1% to 6% by weight of the composition of a substantially water-insoluble ethoxylated $C_{12}$–$C_{15}$ primary aliphatic alcohol containing an average of three ethylene oxide groups per mole;

(c) from 5% to 10% by weight of anionic surfactant mixture comprising, by weight of said mixture, a major proportion of $C_{14}$–$C_{15}$ alkyl sulfate and a minor proportion of $C_{12}$–$C_{15}$ alkyl ethoxyl sulfate containing an average of three ethoxyl groups per mole; and (d) from 15% to 50% by weight of a non-phosphate detergent builder;

wherein the weight ratio of said mixture to the combined weight of said exthoxylated aliphatic alcohol and said polyhydroxy fatty acid amide is in a range from 1:3 to 3:1.

2. A laundry detergent composition according to claim 2 wherein $R_2$ is a $C_{15}$–$C_{19}$ straight chain alkyl or alkenyl group or a mixture thereof and $R_1$ is methyl.

3. A laundry detergent composition according to claim 1, wherein the detergent builder is selected from the group consisting of synthetic crystalline and amorphous zeolite aluminosilicates, alkali metal carbonates, bicarbonates and organic polycarboxylates, alkali metal silicates, crystalline layered sodium silicates, water-soluble salts of acrylic acid homopolymers, and acrylic acid copolymers with maleic anhydride, amino polycarboxylates and mixtures of any of the forgoing.

4. A laundry detergent composition according to claim 1, wherein the anionic surfactant is free of alkyl benzene sulfonate salts and the detergent is in granular form.

* * * * *